US005181625A

United States Patent [19]

Podd, Sr. et al.

[11] Patent Number: 5,181,625

[45] Date of Patent: Jan. 26, 1993

[54] LINER FOR A CARGO CONTAINER

[76] Inventors: Victor T. Podd, Sr.; Victor I. Podd, Jr.; Stephen D. Podd, all of 255 Beverly Avenue, Montreal, Quebec, Canada

[21] Appl. No.: 482,030

[22] Filed: Feb. 15, 1990

[51] Int. Cl.[5] ..... B65D 87/00

[52] U.S. Cl. ..... 220/1.5; 220/403

[58] Field of Search ..... 220/1.5, 400, 401, 403, 220/409, 410, 470; 160/368.1, 370.1; 222/105, 107

[56] References Cited

U.S. PATENT DOCUMENTS

| | | | |
|---|---|---|---|
| Re. 29,721 | 8/1978 | Ukmar et al. | 222/105 |
| 1,259,320 | 3/1918 | Tyler . | |
| 1,815,653 | 7/1931 | Jones . | |
| 2,144,181 | 1/1939 | DuBois . | |
| 2,699,705 | 1/1955 | Csveresko et al. | 160/368.1 X |
| 2,708,542 | 5/1955 | Gray et al. | 226/116 |
| 3,119,351 | 1/1964 | Ford | 105/423 |
| 3,142,265 | 7/1964 | Ford . | |
| 3,384,106 | 5/1968 | Isbrandtsen . | |
| 3,658,205 | 4/1972 | Kassravi | 220/63 R |
| 3,756,469 | 9/1973 | Clark et al. | 222/105 |
| 3,757,990 | 9/1973 | Buth | 220/63 R |
| 3,868,042 | 2/1975 | Bodenheimer | 220/63 R |
| 3,951,284 | 4/1976 | Fell et al. | 220/1.5 X |
| 3,980,196 | 9/1976 | Paulyson et al. | 220/1.5 |
| 4,054,226 | 10/1977 | Bjelland et al. | 220/63 R |
| 4,124,136 | 11/1978 | Bjelland et al. | 160/370.1 X |
| 4,165,024 | 8/1979 | Oswait et al. | 222/105 |
| 4,186,845 | 2/1980 | Podd | 220/461 |
| 4,232,803 | 11/1980 | Muller et al. | 222/105 |
| 4,334,812 | 6/1982 | Delatush | 410/52 |
| 4,345,862 | 8/1982 | Blout et al. | 410/134 |
| 4,399,737 | 8/1983 | Severson | 98/6 |
| 4,441,627 | 4/1984 | Takeuchi | 220/461 |
| 4,461,402 | 7/1984 | Fell et al. | 220/403 X |
| 4,498,824 | 2/1985 | Kinkle | 410/121 |
| 4,557,400 | 12/1985 | Clarke | 220/1.5 X |
| 4,595,126 | 6/1986 | Holmes | 222/105 |
| 4,674,127 | 6/1987 | Yamada et al. | 383/6 |
| 4,759,473 | 7/1988 | Derby et al. | 222/105 |
| 4,799,607 | 1/1989 | Podd | 222/94 |
| 4,884,722 | 12/1989 | Podd | 222/535 |
| 4,966,310 | 10/1990 | Hawkins | 222/105 |

FOREIGN PATENT DOCUMENTS 1205106 5/1986 Canada .

*Primary Examiner*—Steven M. Pollard

*Attorney, Agent, or Firm*—Scully, Scott, Murphy & Presser

[57] ABSTRACT

A flexible liner for lining the interior of a cargo container, and including a multitude of unique connecting segments spaced along edges of the liner to help secure the liner in the cargo container. Each of these connecting segments comprises a multitude of layers located one on top of another and held together over a given area. The layers of a first type of connecting segment include a respective one portion of a first liner panel, a respective one portion of a second liner panel, and first and second sections of a respective one reinforcing member. The layers of each of these connecting segments form a through opening extending through the connecting segment and spaced from the perimeter thereof. The layers of a second type of connecting segment include a respective one portion of a first liner panel, a respective one portion of a second liner panel, first and second sections of a respective one first reinforcing member, and a respective one second reinforcing member. In each of these second type of connecting segments, the fifth layer of connecting segment is captured between a pair of other layers, and is spaced from the perimeter, of the connecting segment.

16 Claims, 12 Drawing Sheets

LINER FOR A CARGO CONTAINER

BACKGROUND OF THE INVENTION

The present invention generally relates to liners for cargo containers, and more specifically, to liners for containers used to carry bulk cargos.

Standardized containers or boxes have come into very extensive use for the shipment of freight by land and sea, and the many advantages of such containers have made it extremely desirable to adapt them for use with as many types of cargo as possible. Accordingly, there have been attempts, with varying degrees of success, to use conventional containers to carry bulk cargo such as dry bulk chemicals, powdered and pelletized resins, flour, coffee and grains.

When cargo containers are used to carry such bulk cargo, it is important that the container itself either be kept clean or be cleaned after each load of cargo is emptied from the container, so that the container can be subsequently used with another load of cargo. Moreover, it is important to protect the bulk cargo from contamination and from undesirable exposure to the natural elements.

For these reasons, large plastic removable liners are often used to line the interior walls or surfaces of the cargo containers that are used to carry bulk cargo. The liner protects the cargo during shipment, for example, from rain and debris; and after the cargo is delivered, the liner can be removed so that the container is again usable, without significant cleaning, to carry other cargo.

Various difficulties have been encountered, however, in using plastic liners in the above-described manner; and in particular, it has been found that the liners often tear or rupture under certain conditions. For example, a cargo container carrying bulk cargo is often emptied by opening the rear doors of the container, and raising the front end of the container to tilt the container so that the cargo slides out the back of the container. Prior art container liners often tear or rupture as the cargo slides rearward through the container and over the liner. Numerous attempts have been made to solve this problem by using braced cardboard or wood bulkheads to help support the liner inside the container, or by hanging the liner from the container roof or walls by means of a multitude of hooks connected to the top perimeter of the liner. These prior art attempts have not been completely successful, however.

It is believed that at least many tears that develop in a liner for a cargo container are caused by wrinkles in the bottom of the liner. Such wrinkles create pockets that trap product inside the liner; and when the container is tilted to empty the product, the weight of the trapped product creates stresses on the bottom of the liner, which may cause the liner to tear.

The number of wrinkles in the bottom of a liner can be substantially reduced or completely eliminated by holding the liner tightly stretched across the interior of the cargo container. If this is done, however, tears or rips may develop in the areas of the liner that are used to secure the liner in place inside the container. To elaborate, a bottom panel of a liner is often simply nailed or stapled to a container floor at a multitude of locations spaced along or adjacent the perimeter of that panel. At the same time, a multitude of ropes may be connected to upper portions of the liner at various locations spaced along or adjacent the top perimeter of the liner, and these ropes may also be connected to hooks on the container walls or ceiling to hold the upper portion of the liner in place. In use, various stresses and forces produced by cargo in the liner, especially if the liner is tightly stretched across the cargo container, may cause the liner to tear partially away from a nail, staple or rope used to connect the liner to the cargo container.

SUMMARY OF THE INVENTION

An object of the present invention is to improve the resistance of cargo container liners to tears and ruptures caused by bulk cargo inside the containers.

Another object of the present invention is to provide a liner for a bulk cargo with unique connecting segments to connect the liner in place inside a cargo container.

A further object of this invention is to provide a liner for a bulk cargo with a multitude of connecting segments spaced around the liner to connect the liner in place inside a cargo container, and to seal each connecting segment to inhibit any tears or rips that may develop in the connecting segment from reaching an interior surface of the liner.

These and other objectives are attained with a flexible liner for lining the interior of a cargo container, and including a multitude of unique connecting segments spaced along edges of the liner to help secure the liner in the cargo container. A first type of connecting segment comprises a multitude of layers located one on top of another and bonded together completely over a given area. The layers of each of these connecting segments form at least one opening extending through those layers and spaced from the perimeter of the connecting segment. Moreover, the layers of each of these connecting segments include a first layer comprising a respective one portion of a first liner panel, a second layer comprising a respective one portion of a second liner panel, a third layer comprising a first section of a respective one reinforcing member, and a fourth layer comprising a second section of the respective one reinforcing member. Preferably, these connecting segments are located along the edges of the liner and are used to connect the upper portion of the liner to the cargo container.

A second type of connecting segment includes a multitude of layers located one on top of another and held together within a given area. The layers of each of these connecting segments include a first layer comprising a respective one portion of a first liner panel, a second layer comprising a respective one portion of a second liner panel, a third layer comprising a first section of a respective one first reinforcing member, a fourth layer comprising a second section of the respective one first reinforcing member, and a fifth layer comprising a respective one second reinforcing member. In each of these second type of connecting segments, the fifth layer of the connecting segment is captured between a pair of the other layers, and is spaced from the perimeter, of the connecting segment. Preferably, these connecting segments are located along bottom edges of the liner and are used to connect the bottom of the liner to the cargo container.

Further benefits and advantages of the invention will become apparent from a consideration of the following detailed description given with reference to the accompanying drawings, which specify and show preferred embodiments of the invention.

A BRIEF DESCRIPTION OF THE DRAWINGS

Figure 12:
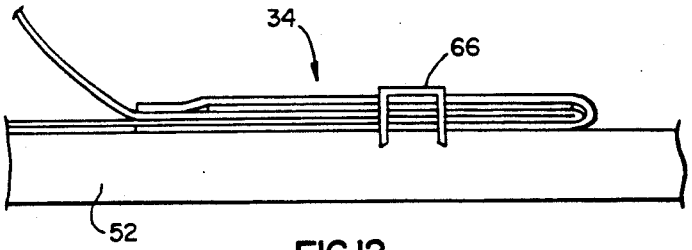

FIG. 12 generally illustrates how a lower connecting segment of the liner may be connected to a floor of the cargo container.

Figure 13:
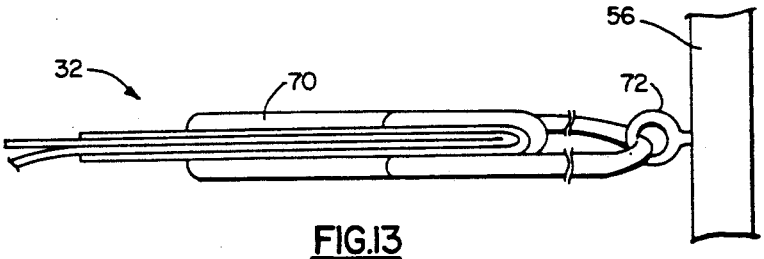

FIG. 13 generally illustrates how an upper connecting segment of the liner may be connected to a wall of the cargo container.

Figure 14:
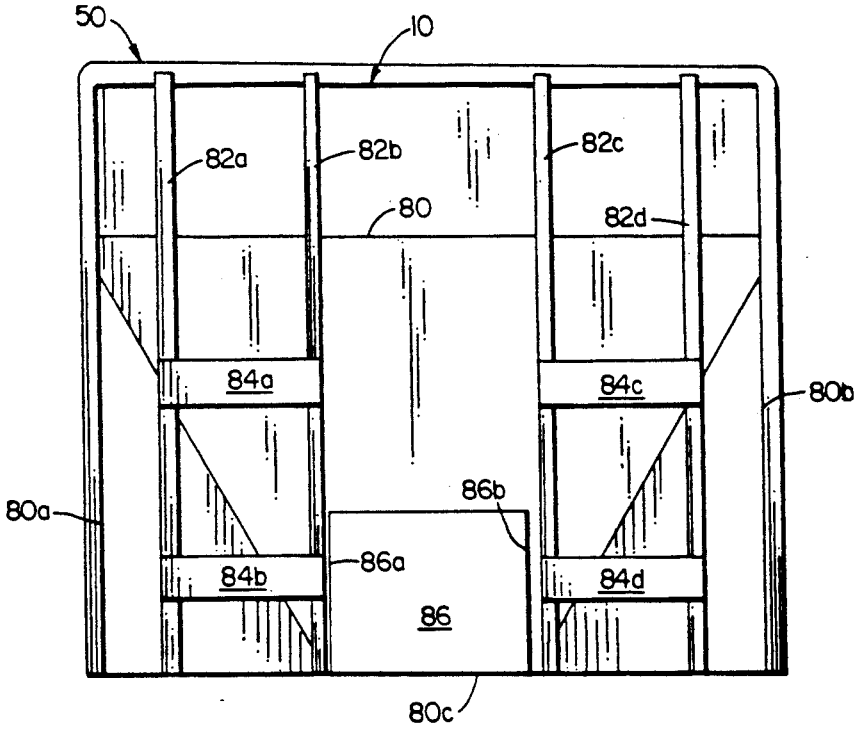

FIG. 14 shows a bulkhead, and a bracing system for the bulkhead, to support the liner in a cargo container.

Figure 15:
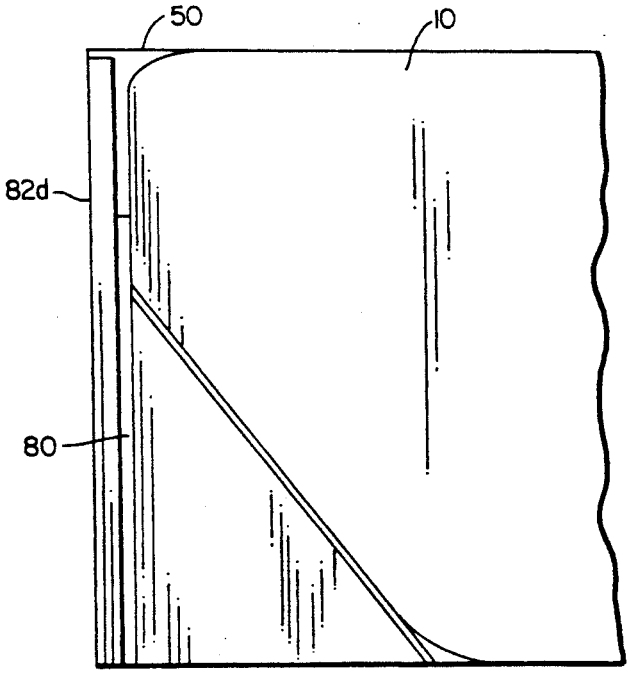

FIG. 15 is a side view of the bulkhead and bracing system of FIG. 14.

Figure 16:
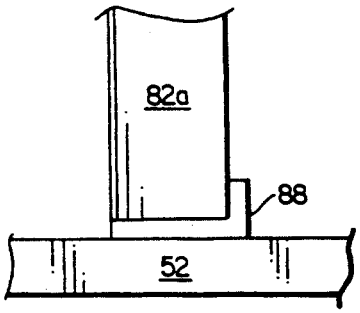

FIG. 16 illustrates how one of the beams of the bracing system of FIGS. 14 and 15 may be connected to the floor of a cargo container.

Figure 17:
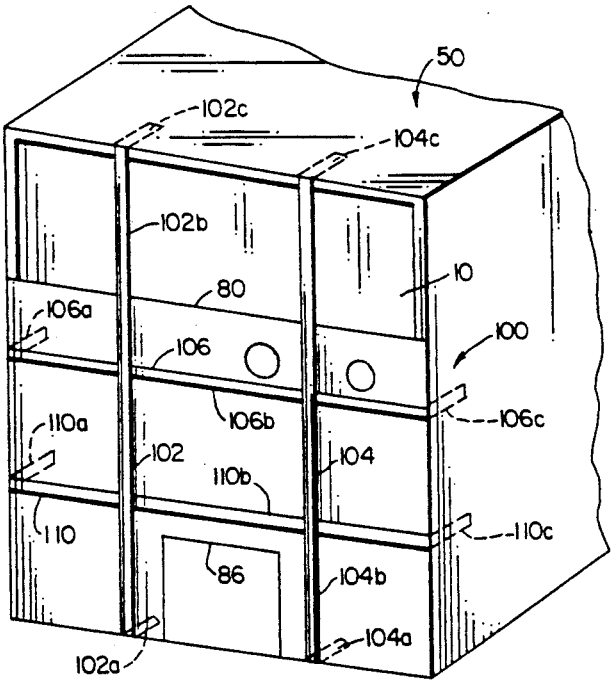

FIG. 17 shows an alternate system for bracing a bulkhead in a cargo container.

Figure 18:
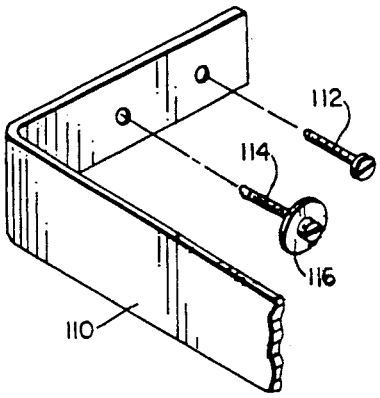
Figure 19:
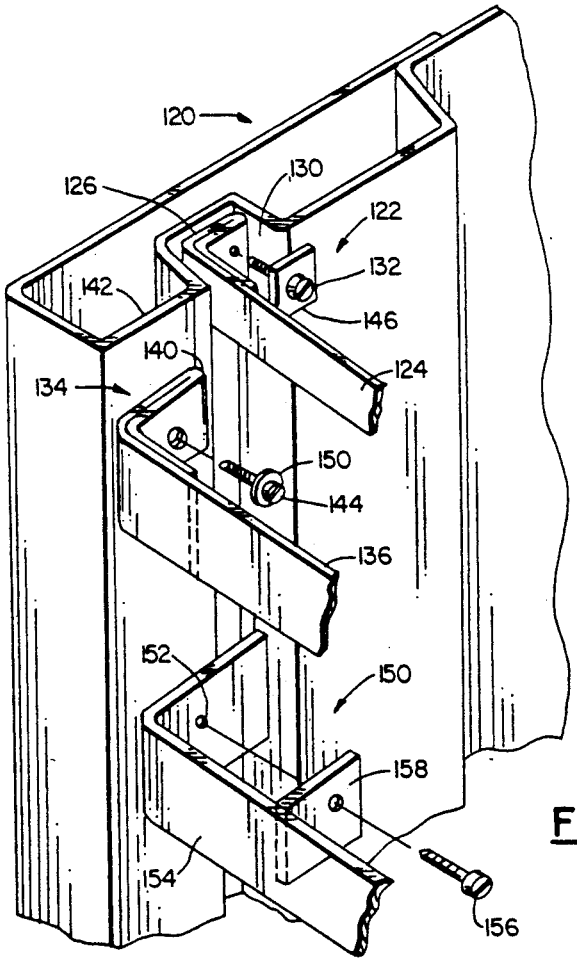

FIGS. 18 and 19 illustrate various arrangements for connected strips of the bracing system of FIG. 17, to a sidewall of the cargo container.

Figure 20:
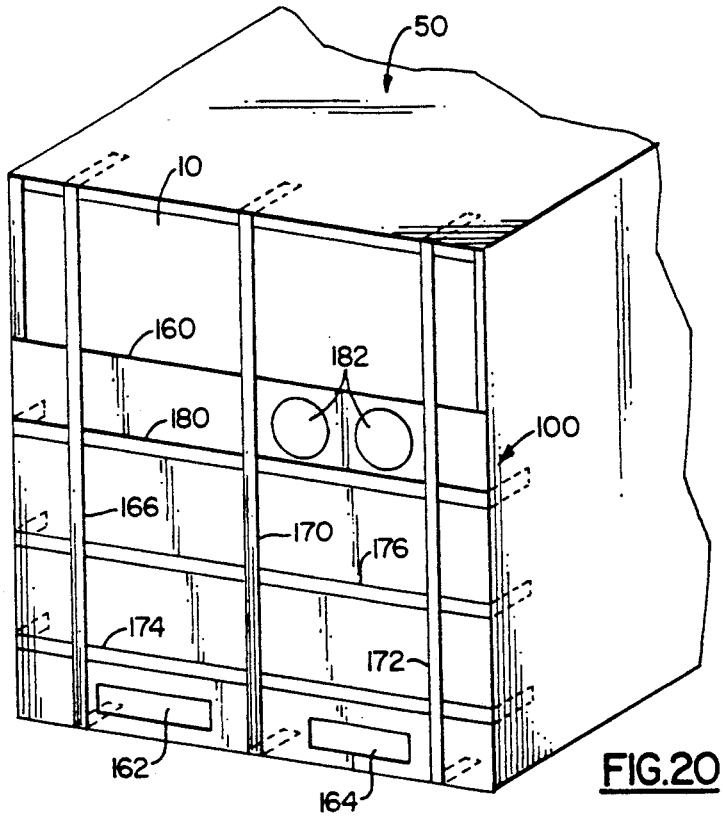
Figure 21:
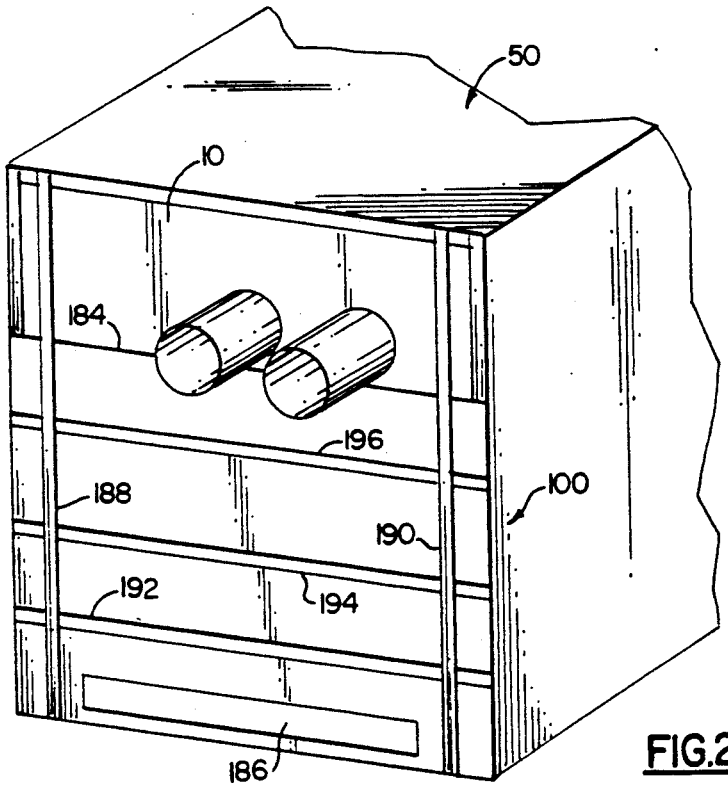

FIGS. 20 and 21 show additional systems for bracing a bulkhead in a cargo container.

FIGS. 22 to 25 show bracing systems that may be used with or without bulkheads, to brace one or more flexible liners in a cargo container.

Figure 26:
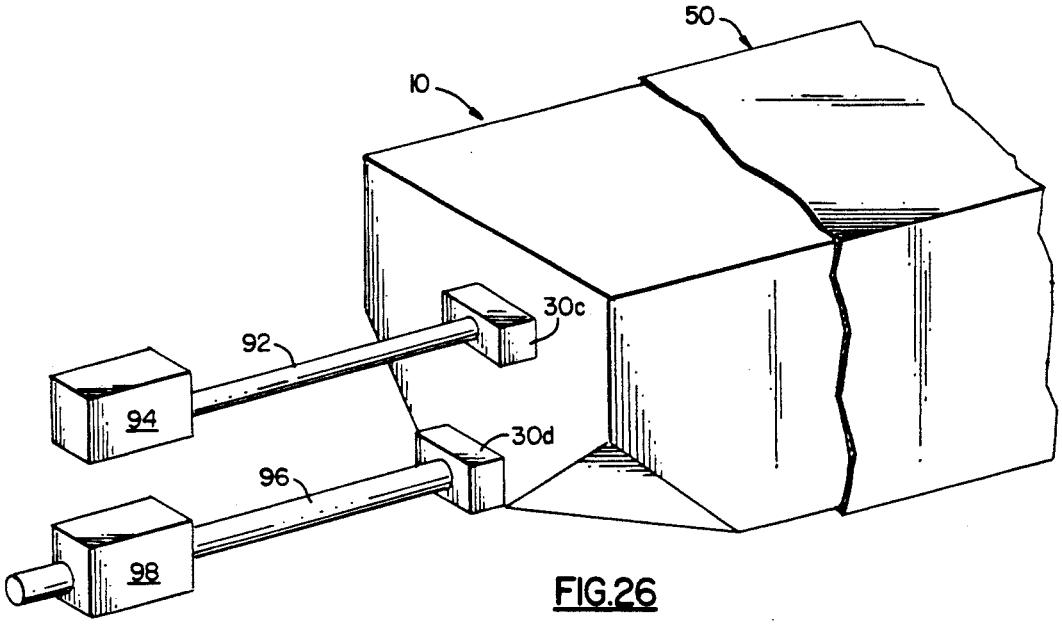

FIG. 26 is a partial perspective view generally depicting a procedure for unloading cargo from a lined cargo container.

Figure 27:
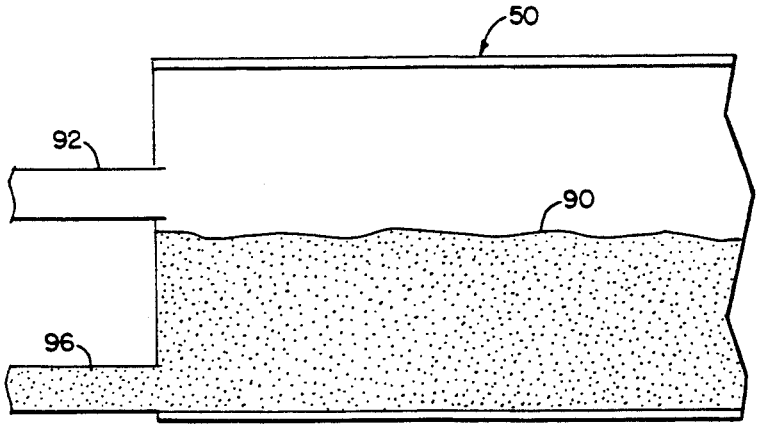

FIG. 27 is a partial sectional view also generally showing cargo being unloaded from the lined cargo container of FIG. 26.

DETAILED DESCRIPTION OF THE PREFERRED EMBODIMENTS

Figure 1:
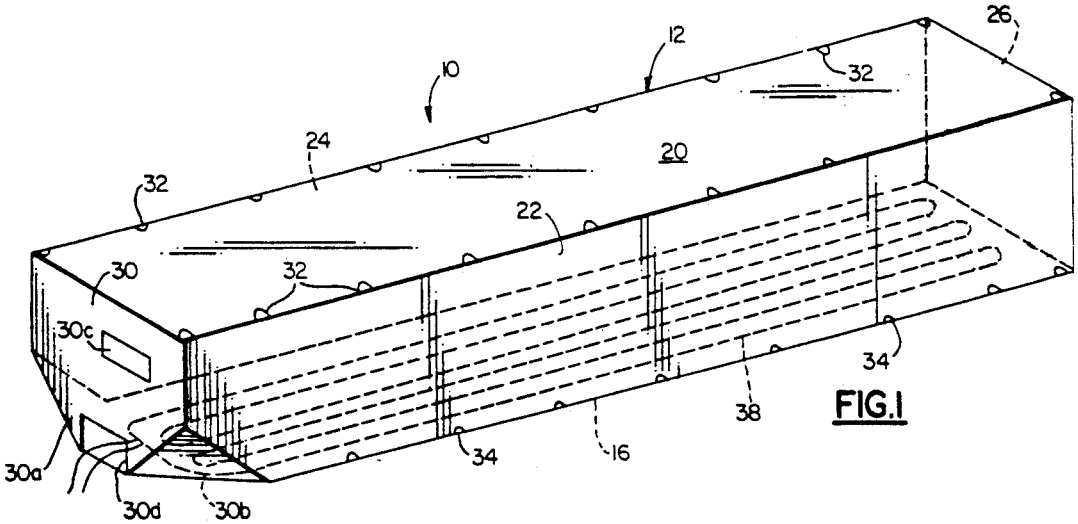
FIG. 1 is an orthogonal view of a container liner according to the present invention.
Figure 2:
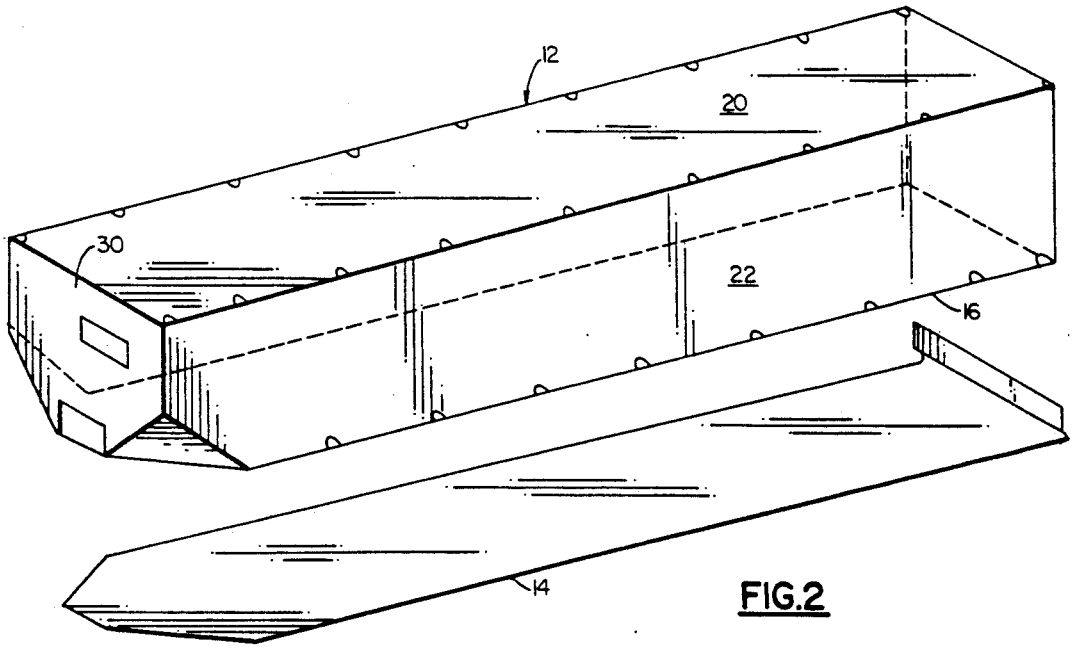
FIG. 2 is similar to FIG. 1 but shows a bottom reinforcing panel of the liner separated from the liner body.
Figure 3:
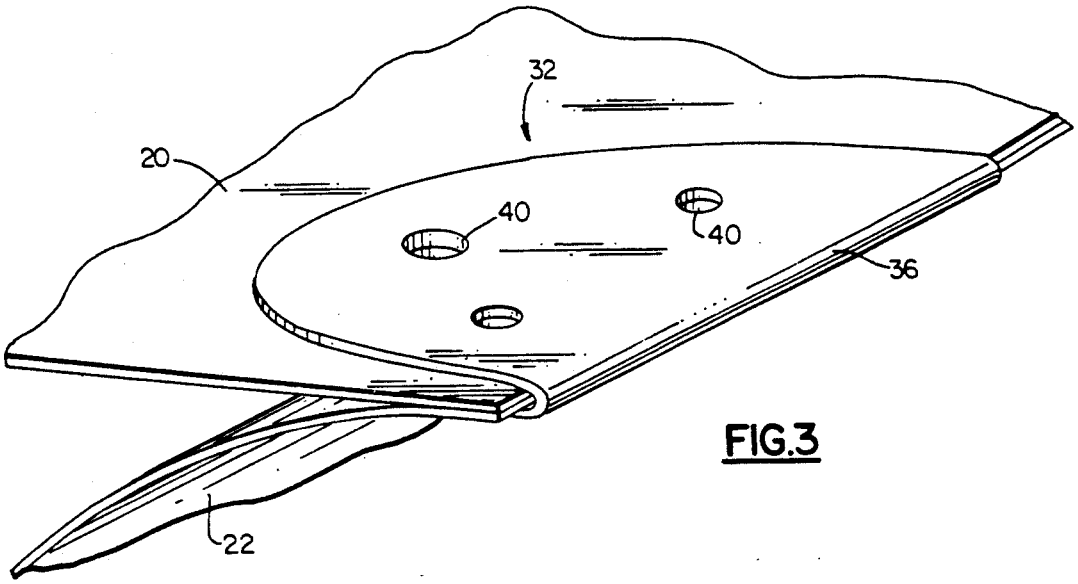
FIG. 3 is an enlarged perspective view of a portion of the liner, and particularly showing an upper connecting segment thereof.
Figure 4:
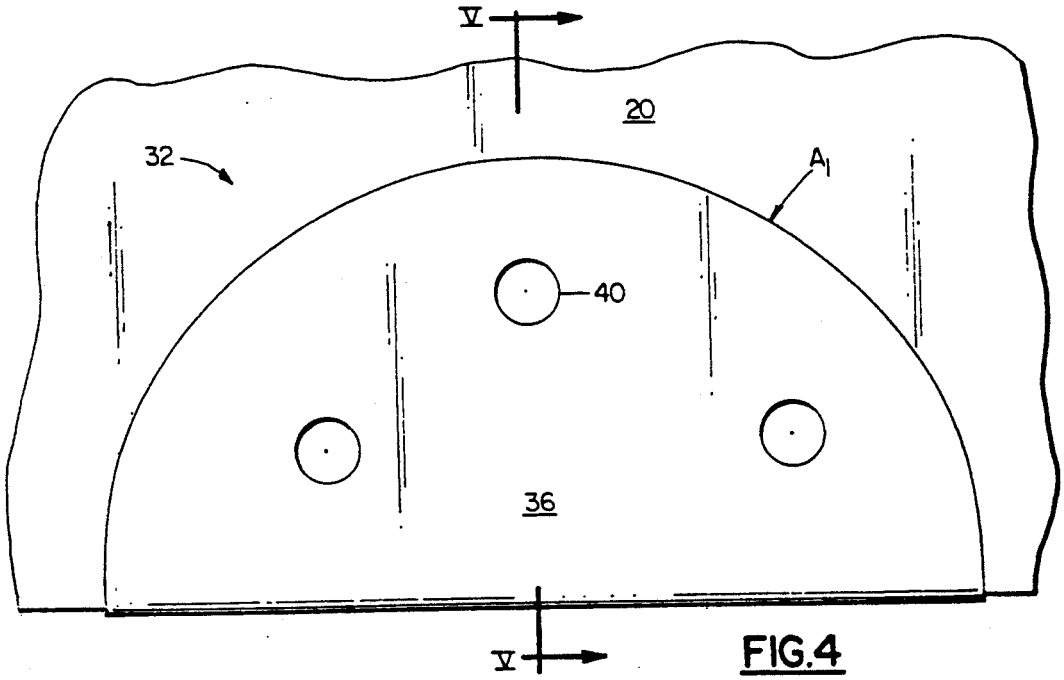
FIG. 4 is a plan view of the upper connecting segment.
Figure 5:
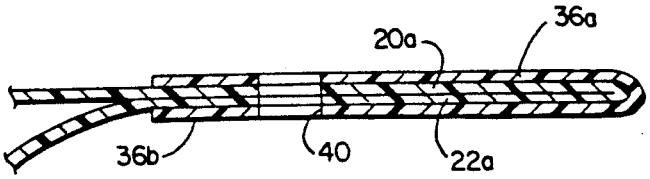
FIG. 5 is a cross-sectional view taken along line V—V of FIG. 4.
Figure 6:
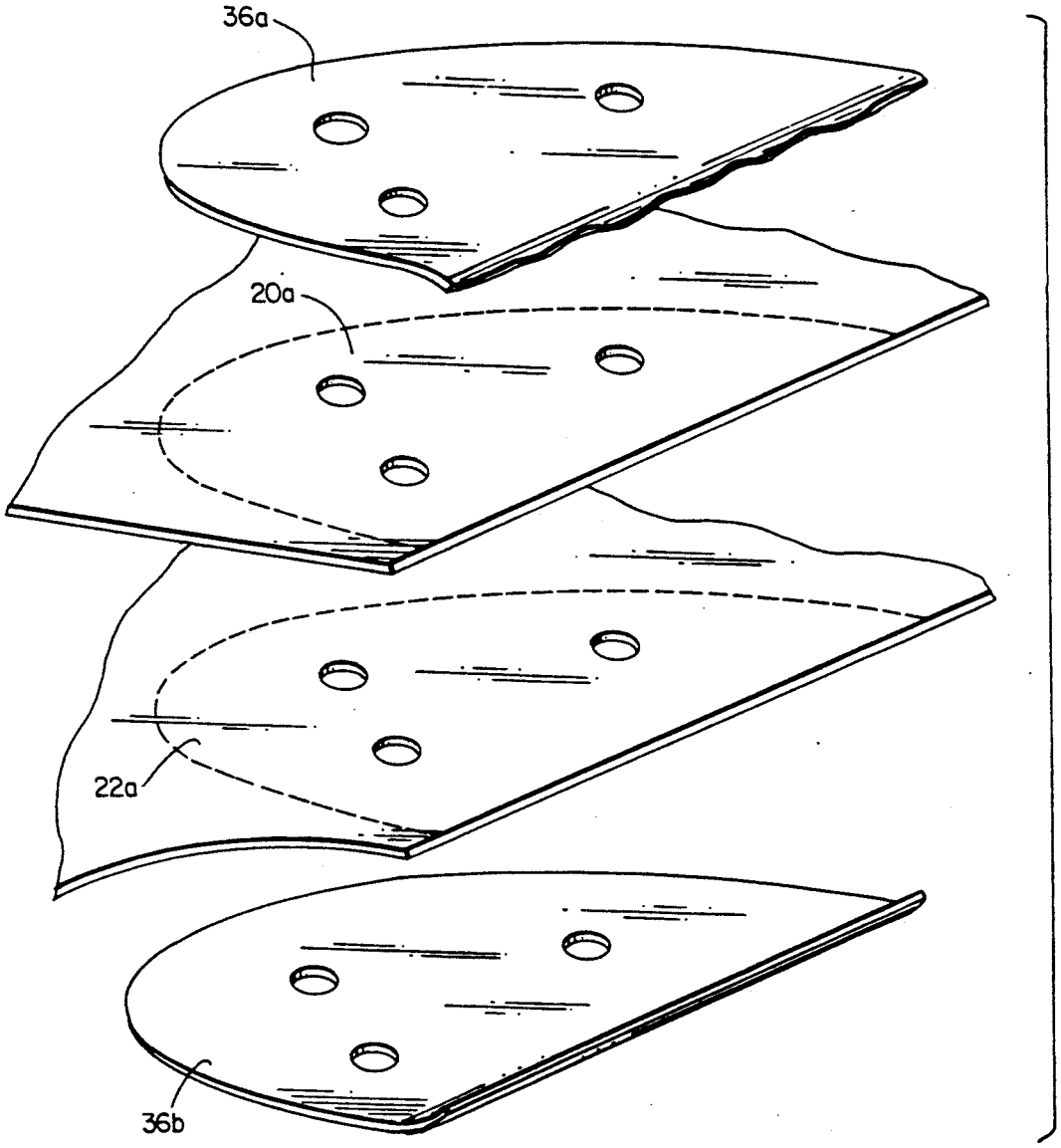
FIG. 6 is an exploded view of the upper connecting segment of FIG. 3.
Figure 7:
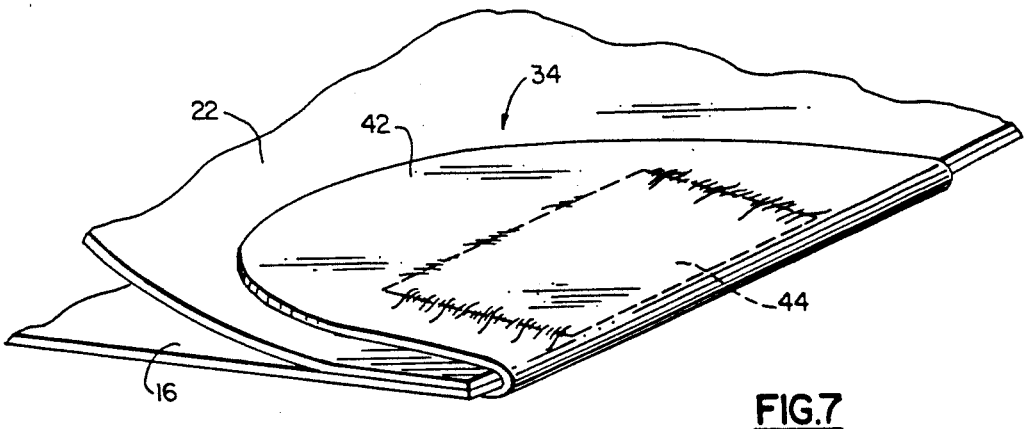
FIG. 7 is an enlarged perspective view of another portion of the liner, and particularly showing a lower connecting segment thereof.
Figure 8:
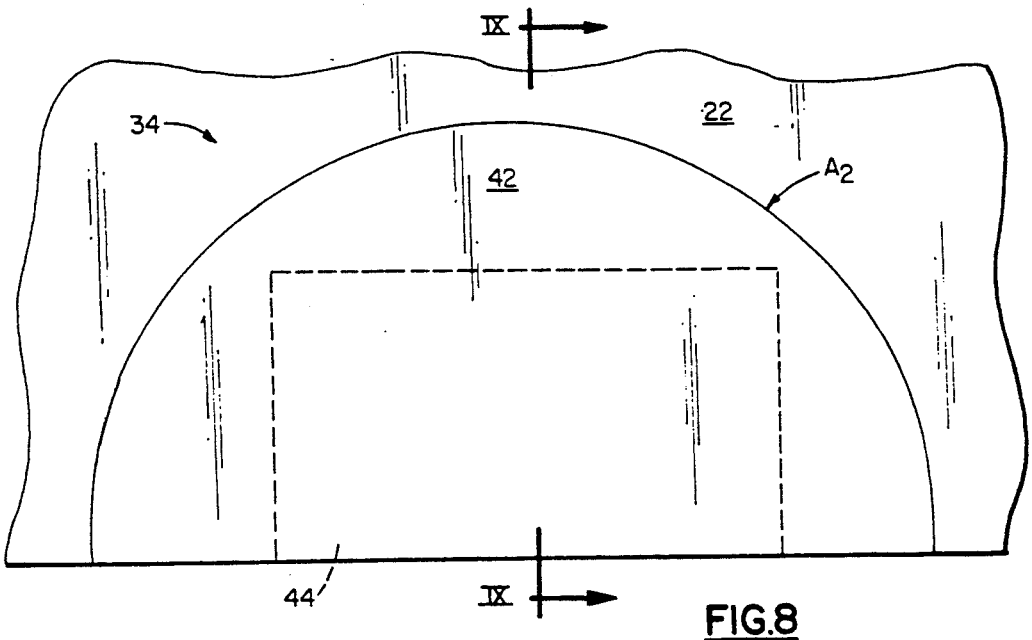
FIG. 8 is a plan view of the lower connecting segment.
Figure 9:
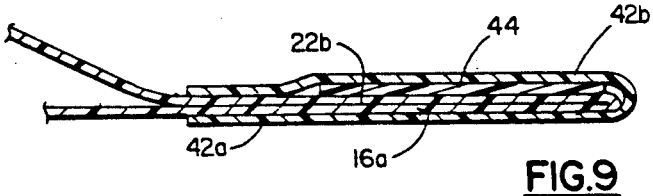
FIG. 9 is a cross-sectional view taken along line IX—IX of FIG. 8.
Figure 10:
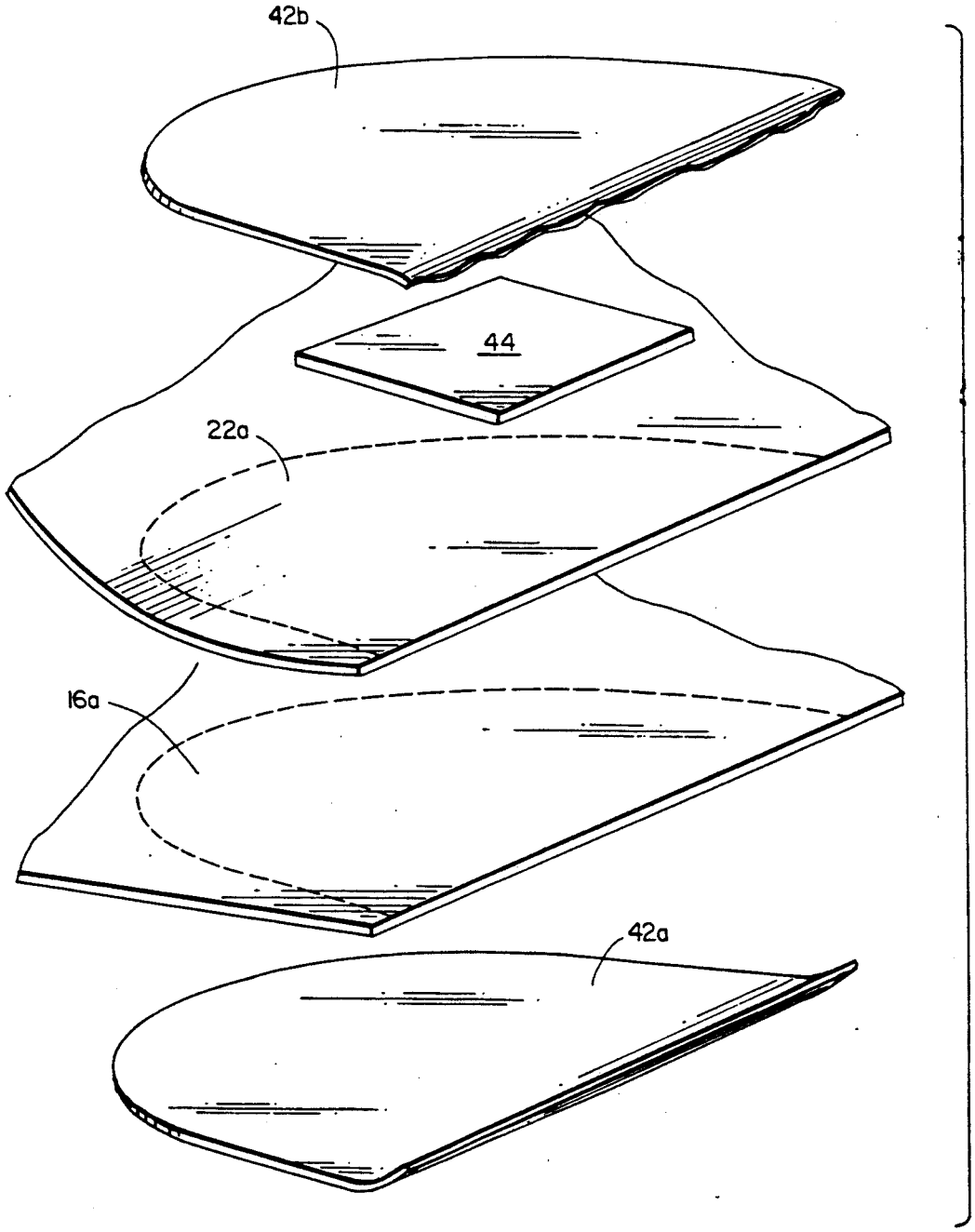
FIG. 10 is an exploded view of the lower connecting segment of FIG. 7.

FIGS. 1 and 2 illustrate an expandable and flexible liner 10 comprising liner body 12, and preferably, liner 10 further comprises reinforcing panel 14. Liner body 12, in turn, includes bottom and top panels 16 and 20, left and right side panels 22 and 24, and front and back panels 26 and 30, which are connected or formed together to form the liner body. Liner 10 is employed to line the interior of a cargo container; and when the liner is inflated or expanded inside the container, the shape of the liner partially or substantially conforms to the shape formed by the interior surfaces of that container. It should be noted, however, that the present invention may be practiced with liners that only partially conform to the shape of the interior of the cargo container with which the liner is used. For example, many liners are only half the height of the cargo containers with which they are used, and the present invention may also be employed with such liners. As illustrated in FIG. 1, liner body 12 has a hollow, substantially parallelpiped shape, although the liner body may be provided with other shapes.

Once liner 10 is positioned inside the cargo container, a bulkhead (not shown) is preferably held or positioned against back panel 30 to help support that panel. Any suitable bulkhead may be employed with liner 10, and one such bulkhead is disclosed in detail in U.S. Pat. No. 4,799,607. To accommodate this bulkhead, back panel 30 has left and right triangular shaped corner portions that form lower right and left back truncated corners 30*a* and *b*. Inlet and outlet openings 30*c* and *d* are provided in back panel 30 to conduct cargo into and out of liner 10, respectively; and these openings may be normally covered by flaps or other closure members. Chutes (not shown) may be connected to back panel 30, adjacent openings 30*c* and *d*, to facilitate loading cargo into or unloading cargo from the liner 10.

An element 38, such as an electric heating ribbon, wire, rope or pipe element may be placed inside or outside of liner 10 to keep product warm inside the liner during transportation, or to liquify product for discharging. For example, this heating element may be used to allow semi-liquid products to be loaded into and discharged from a liner, even though those products may normally have a low viscosity and normally do not flow easily, or the products solidify when cooled such as syrup, chocolate liquor, tallow, hot melt adhesives, waxes, lard and others. It should be noted that element 38 does not have to be an electric heating element; and, for instance, hot or cooled liquids may be conducted through tubes placed in liner 10 or in a cargo container, with circulation methods, from heated or cooled tanks to heat or cool, respectively, the contents of the liner, if desired.

Liner body 12 may be made in any suitable manner and from any suitable material, and for example, the liner body may be made from a thin plastic material such as polyethylene having a thickness of 7 mils. Liner body 12 may be formed from one large sheet of plastic material and folded into the desired shape. Alternatively, panels 16, 20, 22, 24 and 26 may be formed from one large sheet of material and folded into the desired shape, with back panel 30 subsequently connected to panels 16, 20, 22 and 24 to form the complete liner body. As still another example, each panel of liner body 12 may be formed separately, and the panels may be connected together to form the desired liner body. Preferably, any suitable technique may be employed to make any necessary connections between the panels of the liner body; and for instance, the liner body panels may be heat sealed together, or sewn or glued together.

Reinforcing panel 14 is secured to the bottom panel 16 of liner body 12 to reinforce the latter panel, and preferably the reinforcing panel extends under and is connected to the bottom surface of bottom panel 16. Reinforcing panel 14 extends rearward from, or from a position adjacent, the front edge of the liner, and preferably this reinforcing panel extends rearward over the complete length of bottom panel 16.

Reinforcing panel 14 may also be secured to a bottom portion of front panel 26 of liner body 12 to reinforce this area of the latter panel, and preferably the reinforcing panel extends upward approximately 25 percent of the height of panel 26. Reinforcing panel 14 may extend to a higher or lower height; and, if desired, the reinforcing panel may completely cover front liner panel 26.

Reinforcing panel 14 also may be made from any suitable material and in any suitable manner, and connected to liner body 12 in any suitable way. Preferably, in liner 10, panel 14 has a high resistance to stretching at least along the length of the liner. For example, the reinforcing panel 14 may be constructed of woven polyethylene and polypropylene fabric also having a thickness of about 7 mils. Alternatively, the reinforcing panel could be made from strips, such as 2 inch strips, of fiberglass tapes, metal reinforced tapes or polyester reinforced tapes, or the reinforcing panel could be made from coextruded crosslaminated plastic film, or coextruded, or cross laminated film.

The use of reinforcing panel 14 is not necessary to the practice of the present invention in its broadest sense, and it may be possible to provide liner 10 with the desired longitudinal strength by forming the whole liner body 12 from a high strength material that would provide the desired resistance to stretching. Using the reinforcing panel 14 is preferred, however, because this is a very simple, economical and effective way to provide liner 10 with the desired longitudinal strength.

To hold liner 10 in place in a cargo container, the liner is provided with a first, or upper, set of connecting segments 32 positioned around the top of the liner, and a second, or lower, set of connecting segments 34 positioned around the bottom of the liner. The upper connecting segments 32 are substantially identical to each other, and hence, only one of these connecting segments, illustrated in FIGS. 3–6 will be described herein in detail. This connecting segment comprises a multitude of layers of material, including a portion 20*a* of top panel 20, a portion 22*a* of side panel 22, and a pair of layers 36*a* and *b* formed by a reinforcing member 36, bonded together over a given area $A_1$. The layers of connecting segment 32 are located one on top of another, and each layer of the connecting segment is bonded to each adjacent layer of the connecting segment over the entire above-mentioned given area $A_1$. At least one, and preferably a plurality of openings 40, extend through the layers of the connecting segment 32, spaced from the perimeter of the given area $A_1$. Because openings 40 are spaced from the perimeter of area Al, the layers 20*a*, 22*a* and 36*a* and *b* of connecting segment 32 form a seal between those openings and the interior of liner 10.

With the arrangement shown in the drawings, portion 20*a* of top panel 20 is in direct contact with and is bonded directly to portion 22*a* of side panel 22 over area $A_1$, a first section 36*a* of reinforcing member 36 is in direct contact with and is bonded to an outside surface of portion 20*a* of top layer 20 over area $A_1$, and a second section 36*b* of reinforcing member 36 is in direct contact with and is bonded directly to an outside surface of portion 22*a* of side panel 22 over area $A_1$. This arrangement is not necessary to the present invention is its broadest sense, however, and the reinforcing member 36 may be held between portion 20*a* of top panel 20 and portion 22*a* of side panel 22, instead of being located outside these two panel portions. Reinforcing member 36 may be made of any suitable material, although preferably this member is made of the same material from which liner body 12 is made. Moreover, as particularly shown in FIGS. 3 and 4, connecting segment 32 has a semi-circular shape. This also is not essential to the present invention, and the connecting segment may be provided with any suitable shape. For instance, the connecting segment may have a square, rectangular or semi-oval shape.

To form connecting segment 32, generally, portions 20*a* and 22*a* of top panel 20 and side panel 22 respectively are placed together, reinforcing member 36 is positioned against panel portions 20*a* and 22*a*; and these panel portions are bonded to each other and reinforcing member 36 is bonded to both panel portions 20*a* and 22*a* over area $A_1$. Then, the desired openings 40 are formed through the layers of the connecting segment. Typically, when connecting segment 32 is formed, the size of reinforcing member 36 will be larger than necessary to form layers 36*a* and *b* shown in the drawings; and after the reinforcing member is bonded to portions 20*a* and 22*a* of top and side panels 20 and 22, the excess of the reinforcing member outside the sealed area $A_1$, is cut or trimmed away.

Layers 20*a*, 22*a*, 36*a* and *b* may be bonded to each other to form connecting segment 32 in any suitable manner, although preferably these layers are all bonded together in a single, heat sealing operation. Alternatively, the layers of the upper connecting segment may be secured together by an adhesive In addition, preferably openings 40 are at least one-half inch from the perimeter of area $A_1$.

As previously mentioned, all of the upper connecting segments 32 are substantially identical. As will be appreciated by those of ordinary skill in the art, a principle difference between the upper connecting segments on left side of the liner and those on the right side of the liner is that the former segments include a portion of top panel 20 and a portion of left panel 32, while the latter segments include a portion of top panel 20 and a portion of right panel 24. Also, liner 10 may be provided with additional upper connecting segments positioned along the upper front and back edges of the liner. The connecting segments positioned along these front and back edges of the liner may be very similar to the connecting segments illustrated in FIGS. 3–6, with the exception that the connecting segments positioned along the front upper edge of the liner would be formed, in part, by to panel 20 and front panel 26, while the upper connecting segments positioned along the upper back edge of the liner would be formed, in part, by top panel 20 and back panel 30.

Lower connecting segments 34 are substantially identical to each other, and hence only one of these connecting segments, illustrated in FIGS. 7–10, will be described herein in detail. This connecting segment comprises a multitude of layers of material, including a portion 16*a* of bottom panel 16, a portion 22*b* of side panel 22, a pair of layers 42*a* and *b* formed by first reinforcing member 42, and one layer formed by second reinforcing member 44. Layers 16*a*, 22*b*, 42*a* and *b* and 44 of connecting segment 34 are located one on top of another; and these layers are connected together over a given area $A_2$, with layer 44 sandwiched between a pair of other layers of the connecting segments. With the arrangement shown in the drawings, portion 22*b* of side panel 22 is in direct contact with and is bonded directly to portion 16*a* of bottom panel 16, first section 42*a* of reinforcing member 42 is in direct contact with and is bonded directly to portion 16*a* of bottom panel 16, second reinforcing member 44 is located directly on top of portion 22*b* of side panel 22, second section 42*b* of reinforcing member 42 is located directly on top of second reinforcing member 44 and extends past that reinforcing member, and the portion of the second reinforcing member 42 that extends past the first reinforcing member 44 is in direct contact with and is bonded to portion 22*b* of side panel 22. In this way, layers 22*b* and 42*b* form a seal extending completely around second reinforcing member 44, between that reinforcing member 44 and the interior of liner 10.

The specific relative position of the various layers of connecting segment 34 that is shown in the drawings is not necessary, and for example, second reinforcing member 44 may be located between portion 22*b* of side panel 22 and portion 16*a* of bottom panel 16, or between bottom panel portion 16*a* and bottom section 42*a* of the first reinforcing member 42. Further, as particularly shown in FIGS. 7 and 8, connecting segment 34 has a semi-circular shape, and second reinforcing member 44 has a rectangular shape. None of these shapes is essential, though; and both the connecting segment 34 and the second reinforcing member 44 may have any suitable shapes. For instance, connecting segment 34 may have a square, rectangular or semi-circular shape; and second reinforcing member 44 may have a square, circular, oval or semi-circular shape.

Reinforcing members 42 and 44 may be made of any suitable materials. Preferably, reinforcing member 42 is made from the same material from which liner body 12 is made; while reinforcing member 44 is made of a high strength material. For instance, preferably reinforcing member 44 is made from a woven fabric such as nylon or polyester; and alternatively this reinforcing member could be made from fiberglass tape, metal reinforced tape or polyester reinforced tape.

To form connecting segment 34, generally, portion 16*a* of bottom panel 16 and portion 22*b* of side panel 22 are placed together, section 42*a* of reinforcing member 42 is positioned against bottom panel portion 16*a*, second reinforcing member 44 is positioned against side panel portion 22*b*, section 42*b* of reinforcing member 42 is placed over reinforcing member 44 and against side panel portion 22*b*; and layers 42*a*, 16*a*, 22*b* and 42*b* are bonded together. These layers may be bonded to each other in any suitable procedure; however, preferably they are all bonded together in a single heat sealing operation. Alternatively, the layers of connecting segment 34 may be adhesively secured together. Preferably, second reinforcing member 44 is at least one half inch from the perimeter of area $A_2$, maintaining a one-half inch seal between that reinforcing member and the interior of the liner 10. Commonly, when connecting segment 34 is formed, the size of first reinforcing member 42 will be larger than necessary to form layers 42*a* and *b* shown in the drawings; and after that reinforcing member is bonded in place to form the connecting segment 34, the excess portion of that first reinforcing member outside area $A_2$ is cut or trimmed away.

Figure 11:
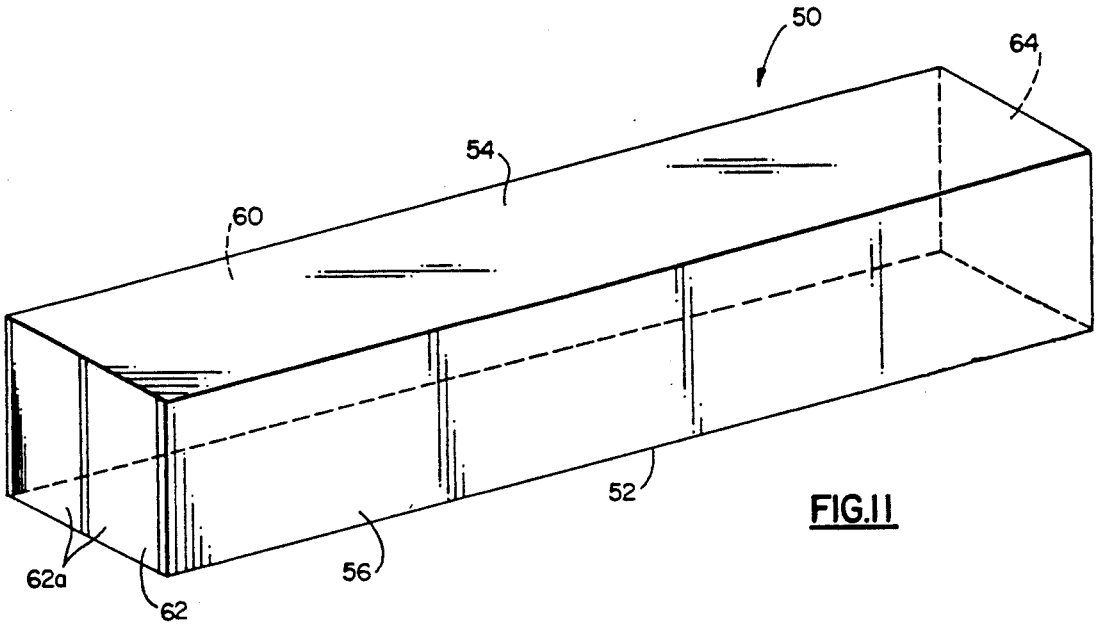
FIG. 11 shows a container with which the liner of FIG. 1 may be used.

Liner 10 may be used with any suitable cargo container; and, for example, FIG. 11 illustrates a container 50 with which the liner may be used. This container has a conventional size and shape, and in particular, includes a container body having floor and roof 52 and 54, left and right side walls 56 and 60, and back and front walls 62 and 64. Back wall 62 includes a pair of outwardly hinged doors 62*a* which provide access to the interior of the container.

Generally, in the inflated position of liner 10, bottom panel 16 of the liner extends over floor 52 of container 50, left and right side liner panels 22 and 24 respectively extend over left and right side walls 56 and 60 of the container, and front liner panel 26 extends over container front wall 64.

To install liner 10 inside a cargo container 50, the liner is placed inside the container, with bottom panel 24 on or over container floor 52 and with the left and right bottom edges of the lines adjacent the left and right bottom inside edges of container 50. Liner 10 may be in a collapsed, comparatively flat condition when it is placed in the container, with top panel 26 lying closely over bottom panel 24, and with side panels 30 and 32 folded inward between the top and bottom panels. The liner 10 may be placed in the container in a further folded or rolled condition, and then unfolded or unrolled into the above-mentioned comparatively flat condition.

After liner 10 is unfolded or unrolled onto floor 52 of container 50, lower connecting segments 34 are secured to that floor, and FIG. 12 illustrates how this can be done. Generally, to fasten lower connecting segment 34 to container floor 52, that connecting segment is placed on and then stapled to the container floor, with the staple 66 extending through second reinforcing member 44, preferably through a central portion thereof. In a typical application, each of the lower connecting segments 34 of liner 10 is fastened to the floor of the container. Lower connecting segments 34 may be secured in place in other ways; and for instance, these connecting segments may be nailed or screwed to the container floor 52. Stapling is preferred, however, because it can be done very easily and inexpensively, and because the staples can be removed from the connecting segments quickly and easily.

Supplemental connecting or securing means may be used, in addition to lower connecting segments 34, to connect liner 10 to the floor of container 50. For example, wooden slats may be nailed to the container floor, over lower edges of left and right side panels 22 and 24 of liner 10 to hold the bottom of the liner firmly in place in the container.

Once the bottom of liner 10 is secured in container 50, the liner is partially inflated therein, and this may be done by conducting a gas into the interior of the liner via inlet 30*c*. After the line is partially or fully expanded inside the liner, upper connecting segments 32 are secured either to the roof 54 or to upper portions of the side walls 56 and 60 of the container, and FIG. 13 illustrates how this may be done. Generally, to fasten an upper connecting segment 32 to the container, a rope 70 is extended through one or more of the openings 40 of that connecting segment and connected to a hook 72 or similar device securely connected to or mounted on the inside of the cargo container. In a typical application, container 50 is provided with a multitude of hooks or similar fastening devices adjacent the top inside edges of the container, and each upper connecting segment 32 on liner 10 is fastened to a respective one of these hooks or fasteners. Upper connecting segments 32 may be held in place by means other than ropes; and for example, cords or chains may be employed to connect the upper connecting segments to hooks fastened around the container.

After upper connecting segments 32 are secured to container 50, liner 10 may be fully inflated, and a bulkhead may be installed in the cargo container, against back panel 30 of the liner. Further bracing may be provided to support the back panel of the liner, and liner 10 may then be fully inflated.

For example, FIGS. 14 and 15 illustrate one very effective and reliable, yet inexpensive, arrangement for bracing such a bulkhead, generally referenced at 80. This bracing system comprises vertical beams 82*a–d* and cross beams 84*a–d*. Each of vertical beams 82*a–d* is securely connected to container floor 52 and these beams are spaced apart along the width of bulkhead 80 and extend upward thereagainst to brace the bulkhead in container 50. Each of the beams 82*a–d* extends upward for at least a substantial portion of the height of bulkhead 80; and with the embodiment shown in the drawings, the length of each of the beams 82*a–d* is just slightly less than the inside height of container 50.

With particular reference to FIG. 14, bulkhead 80 includes an outlet opening 86 that is centrally located along a bottom portion of the bulkhead and that, in use, is aligned with outlet 30*d* of liner 10 to conduct cargo outward from the interior thereof. Vertical beam 82*b* is laterally disposed slightly to the left of the left edge 86*a* of outlet opening 86, and beam 82*a* is laterally disposed between beam 82*b* and the left edge 80*a* of bulkhead 80. Analogously, beam 82*c* is laterally disposed slightly to the right of the right edge 86*b* of outlet opening 86, and beam 82*d* is laterally disposed between beam 86*c* and the right edge 80*b* of bulkhead 80. With the specific arrangement shown in the drawings, beam 82*b* is spaced from the left edge 80*a* of bulkhead 80 a distance equal to about one-third of the width of the bulkhead, and beam 82*a* is spaced to the left of beam 82*b* a distance equal to about two-thirds of the distance between that latter beam 82*b* and the left edge 80*a* of the bulkhead. Similarly, beam 82*c* is spaced from the right edge of bulkhead 80 a distance equal to about one-third of the width of the bulkhead, and beam 82*d* is spaced to the right of beam 82*c* a distance equal to about two-thirds of the distance between that beam 82*c* and the right edge 80*b* of the bulkhead.

Cross beams 84*a* and *b* are connected to beams 82*a* and *b* to help hold these latter beams upright, and preferably beams 84*a* and *b* are parallel to each other. Cross beams 84*c* and *d* are connected to beams 82*c* and *d* to help hold these latter beams upright, and preferably beams 84*c* and *d* are parallel to each other. Beams 82*a–d* and beams 84*a–d* can be constructed in modular form sets to save time and labor costs. Preferably beams 84*a–d* are horizontal, although, alternatively, they may be at an angle to the horizontal. As shown in FIG. 14, beam 84*a* is connected to beams 82*a* and *b* about halfway along the height of the beams, and beam 84*b* is connected to beams 82*a* and *b* at about one-third of the distance from bottom edge 80*c* of bulkhead 80 to beam 84*a*. Likewise, beam 84*c* is connected to beams 82*c* and *d* about halfway along the height of those beams, and beam 84*d* is connected to beams 82*c* and *d* at about one-third of the distance from bottom edge 80*c* of bulkhead 80 to beam 84*c*.

Beams 82*a–d* and 84*a–d* may be made of any suitable materials, although preferably they are all wood beams. With the particular arrangement shown in the drawings, each of the vertical beams 82*a–d* has nominal dimensions of two inches by two inches by approximately eight feet, and each of the cross beams 84*a–d* has nominal dimensions of one inch by six inches by twenty-one inches. The preferred dimensions of beams 82*a–d* and 84*a–d* may be different, though, depending on the height and width of the cargo container with which the beams are used. Cross beams 84*a–d* may be connected to vertical beams 82*a–d* in any suitable manner, although preferably these beams are nailed together. Likewise, vertical beams 82*a–d* may be connected to container floor 52 in any acceptable way; and, for instance, a multitude of angle irons, one of which is shown at 88 in FIG. 16, may be nailed to container floor 52 and to beams 82*a–d* to connect those beams to the container floor.

FIG. 17 illustrates an alternate means, generally referenced at 100, for bracing bulkhead 80 in container 50, and in which flexible straps, which may be made of metal or non-metal materials, are substituted for the wood beams shown in FIG. 14, eliminating the need and the cost of those wood beams. Bracing means 100 includes a plurality of generally vertical, upwardly extending straps 102 and 104, and a plurality of laterally extending straps 106 and 110. Straps 102 and 104 are connected to and extend between the floor and the ceiling of the body of container 50, and are held against bulkhead 80; and straps 106 and 110 are connected to and extend between the left and right side walls of the container body, and also are held against the bulkhead.

More specifically, each of the upwardly extending straps 102 and 104 includes a bottom portion, a top portion and a main portion; and in FIG. 17, the bottom, top and main portions of strap 102 are referenced as 102*a, b* and *c* respectively, and the bottom, top and main portions of strap 104 are referenced as 104*a, b* and *c* respectively. The bottom portion of each strap 102, 104 horizontally extends along and is connected to the floor of the container body, the top portion of each of these straps horizontally extends along and is connected to the ceiling of the container body, and the main portion of each strap 102, 104 is connected to and extends between the bottom and top portions of the strap and is held against bulkhead 80.

Each of the laterally extending straps 106, 110 includes a left portion, a right portion, and a main portion; and in FIG. 17, the left, right and main portions of strap 106 are referenced at 106*a, b* and *c* respectively, and the left, right and main portions of strap 110 are referenced at 110*a, b* and *c* respectively. The left portion of each lateral strap extends against and is connected to the left side wall of container 50, the right portion of each lateral strap extends against and is connected to the right side wall of the container, and the main portion of each lateral strap is connected to and extends between the left and right connecting portions of the strap, and is held against bulkhead 80.

The straps used in bracing means 100 may be made of any suitable material; and for instance, the straps may be made of a flexible, high strength metal. Alternatively, these straps may be constructed of woven polyethylene and polypropylene, or the straps may be made from strips, such as 2" strips, of fiberglass tapes, metal reinforced tapes or polyester reinforced tapes. As still additional examples, the biasing straps could be made from coextruded crosslaminated plastic film, or co-extruded, or cross-laminated film. Typically, metal straps are preferred because they can be made with a relative high resistance to stretching. Metal straps of various width and thicknesses may be used in bracing system 100; and for instance, the width of the straps may be between ¾"

and 3" or 4", the thicknesses of the straps may be between 20 and 80 mills, and each strap may have a break strength of between 2,000 and 60,000 pounds.

The straps of bracing means 100 may be connected to the body of container 50 in any acceptable manner; and as an example, and with reference to FIG. 18, self drill or self tapping screws 112 and 114 may be used to secure strap 110 to the container body. To allow this, the strap and the container body are provided with suitable openings to receive those screws. These openings may be formed in the container body and the bracing straps before the straps are positioned against the container body, or self tapping screws may be used to form those openings as the bracing straps are screwed to the container body. Washers, such as washer 116 may be disposed between the bracing straps and the heads of the screws used to connect those straps to the container body. As will be understood by those of ordinary skill in the art, the straps of bracing means 100 may be secured in place in other ways; and, for example, depending on the material from which the straps are made and the specific material to which the straps are secured, the straps may be nailed, stapled, welded or bolted in place.

FIG. 19 illustrates three alternate ways for connecting a strap to a container body, specifically a side wall 120 thereof. With the arrangement shown at 122, an end portion of strap 124 is folded over and against itself, forming a double thickness section 126; and a portion of this section 126 is held against the container side wall, inside a vertical groove 130, and a self tapping screw 132 is threaded through this double thickness section and into the container side wall, connecting the strap thereto. Similarly, with the arrangement shown at 134, an end portion of strap 136 is folded over and against itself, forming double thickness section 140; and a portion of this section 140 is held against the container side wall, specifically a surface 142 thereof, and a self tapping screw 144 is threaded through this double thickness section and into the container side wall, connecting the strap thereto.

With both of the procedures discussed immediately above, as the self tapping screw is threaded through the bracing strap and into the container side wall, that screw forms aligned openings in the strap and the container side wall. Also, washers, such as square washer 146 or round washer 150, may be disposed between the bracing strap and the head of a screw used to connect the strap to the container side wall.

The double thickness sections 126 and 140 of straps 124 and 136 respectively, provide additional strength to prevent the screws 132 and 144 from tearing the bracing straps. As indicated above, preferably double thickness sections 126 and 140 are formed by folding over end portions of straps 124 and 136 respectively. Double thickness sections may be formed in other ways; and, for example, a separate piece of material may be placed over and secured to an end portion of a strap to form a section having a double thickness.

With the connecting arrangement shown at 150, an opening (not shown) is formed in the container side wall, and a through hole 192 is formed in an end portion of strap 194. Strap 154 is placed against the container side wall with these two openings aligned, and a screw 156 is threaded through these two openings to connect the strap to the container side wall. A washer 158 may be positioned between the end portion of strap 154 and the head of screw 156.

Bracing means 100 may include any suitable number of upwardly extending straps and any suitable number of laterally extending straps, and these straps may be arranged in various patterns. The preferred number and pattern of the bracing straps depends in part on the specific bulkhead with which the straps are used, and more specifically, on the location of the inlet and discharge openings in that bulkhead. For instance, with the bulkhead 80 shown in FIG. 17, and which includes a central bottom discharge opening 86, strap 102 extends upwards, substantially vertically, adjacent and laterally to the left of the left edge of the discharge opening, and strap 104 extends upward, substantially vertically, adjacent and laterally to the right of the right edge of the discharge opening. Moreover, as shown in FIG. 17, lateral straps 106 and 110 are substantially horizontal; however, this is not necessary and instead these straps may extends across bulkhead 80 at an acute angle to the horizontal, either parallel to each other, or forming an x across the bulkhead.

FIG. 20 shows a cargo container 50 having an alternate bulkhead 160 having two lower discharge openings 162 and 164.. The embodiment of bracing means 100 used with this bulkhead includes three upwardly extending straps 166, 170 and 172, and three laterally extending straps 174, 176 and 180. Strap 166 extends upwards, substantially vertically and laterally to the left of the left discharge opening 162; strap 170 extends upwards, substantially vertically and laterally between the discharge openings 162 and 164; and strap 172 extends upwards, substantially vertically and laterally to the right of the right discharge opening 164. Strap 176 extends horizontally across the bulkhead, generally midway between the top and bottom edges of the bulkhead; strap 166 extends horizontally, slightly above the top edges of the discharge openings; and strap 180 extends horizontally slightly below the bottom edge of inlet openings 182.

FIG. 21 shows cargo container 50 having a third bulkhead 184 that forms a comparatively wide discharge outlet 186. The embodiment of bracing means 100 used with this bulkhead includes first and second upwardly extending straps 188 and 190, and first, second and third lateral straps 192, 194 and 196. Strap 188 extends upwards, laterally between the left edge of the bulkhead and the left edge of opening 186; and strap 190 extends upwards, laterally between the right edge of the bulkhead and the right edge of opening 186. Straps 192, 194 and 196 horizontally extend across the bulkhead and are vertically spaced apart a distance about ¼ the height of the bulkhead itself.

Bracing means 100 maintains a bulkhead in position inside cargo container 50, and allows the bulkhead to withstand the pressure of the commodity inside the liner 10 even when the cargo container is tilted to angles of from 45° to 75° to discharge the cargo from the liner. Bracing means 100 is simple to use, economical and very effective. The desired bracing straps may be connected to the container body by pre-drilling suitable holes in the straps and the container body, and then using screws or bolts to connect the straps to the container body. Further, if steel bracing straps are used, these straps may be securely connected to the container body by means of self tapping screws, eliminating the need to pre-form any holes in the straps or in the container body.

Figure 22:
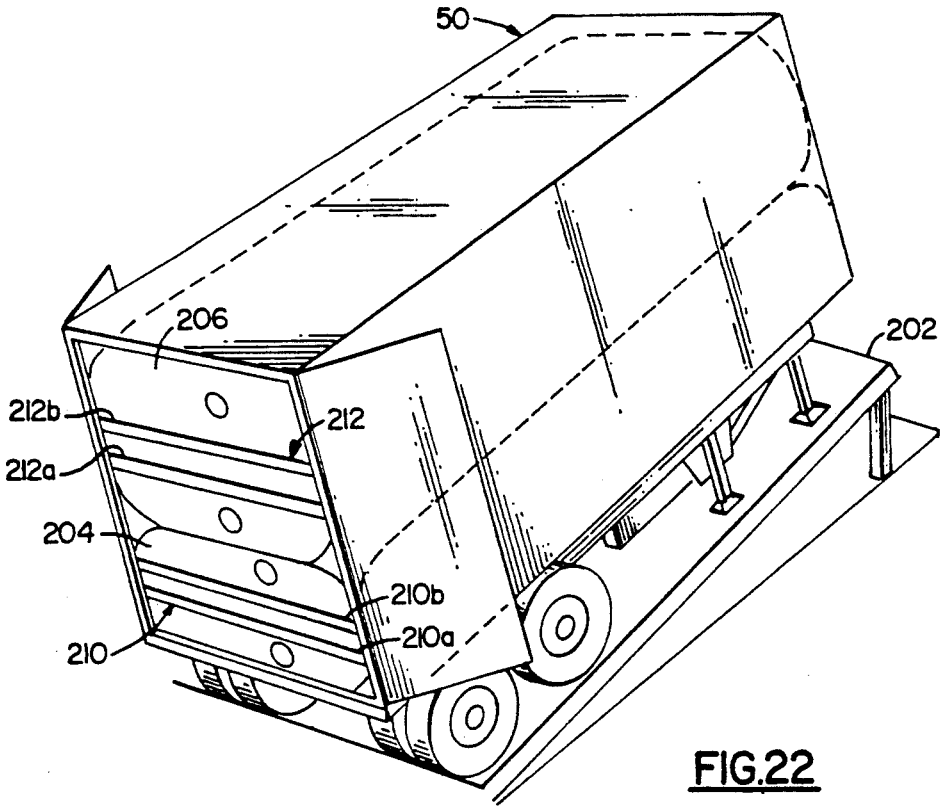
Figure 23:
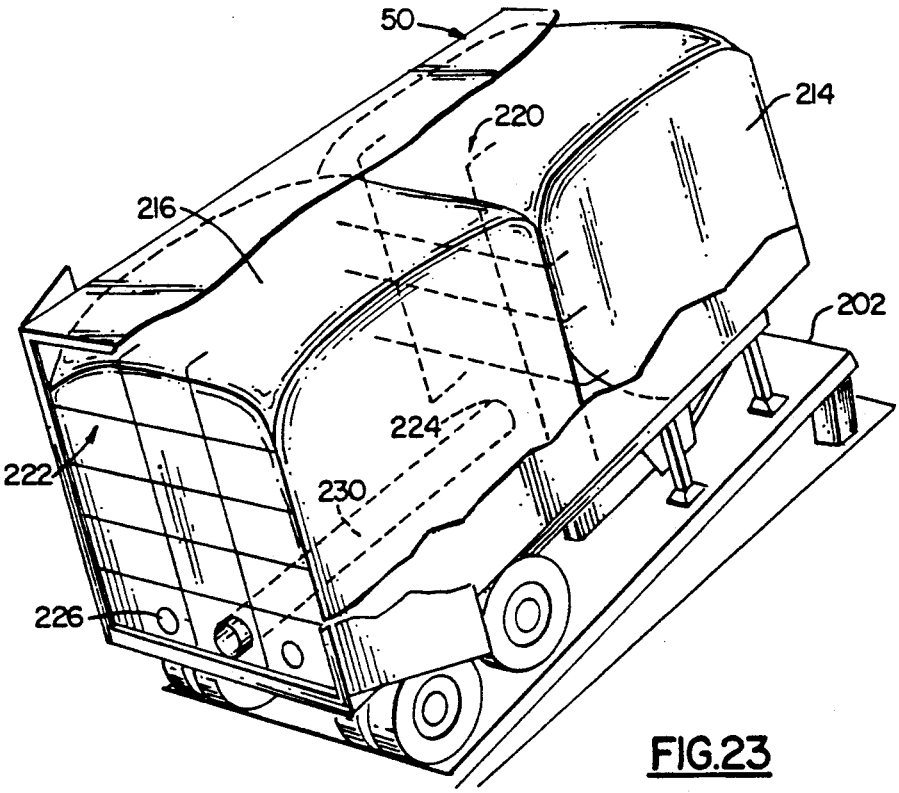
Figure 24:
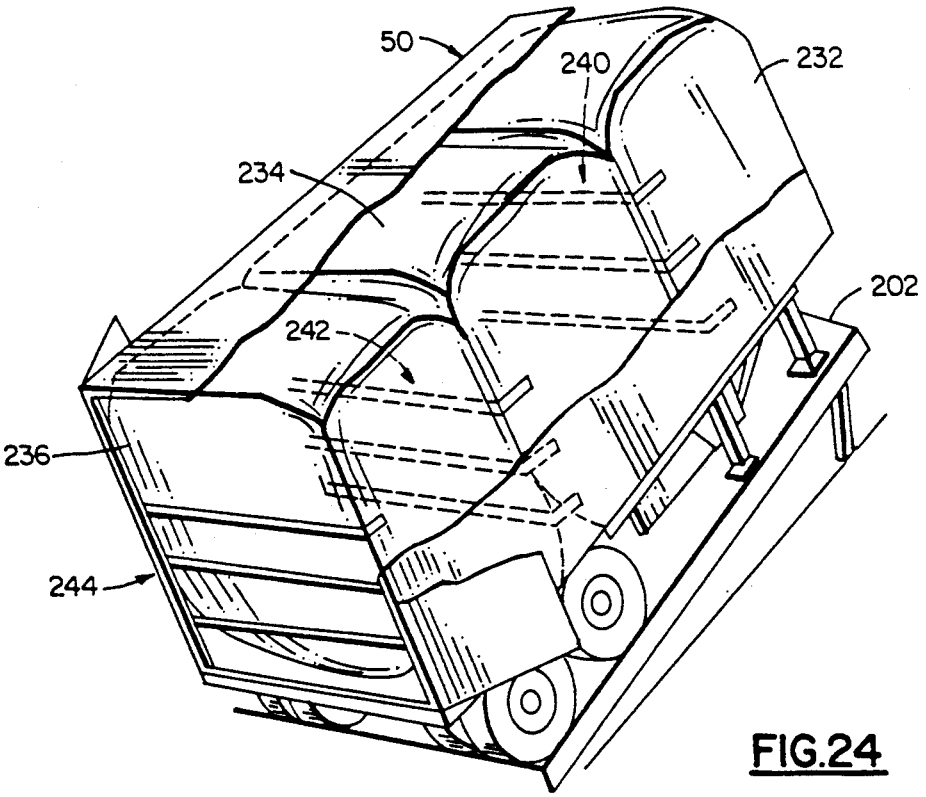

Indeed, bracing means 100 works so effectively that the bracing means may, under some circumstances, eliminate the need for a bulkhead to support a liner inside cargo container 50. This, in turn, increases the number of ways in which a plurality of liners may be held inside the cargo container; and for example, FIGS. 22–25 illustrate four arrangements for positioning and holding a plurality of liners inside cargo container 50. Each of FIGS. 22–24 shows a cargo container 50 including a plurality of flexible and expandable liners secured in the cargo container, and a plurality of bracing means, with each bracing means engaging and supporting a respective one of the liners inside the cargo container. FIGS. 22–24 also show the cargo container mounted on a tiltable platform 202 that may be used to tilt the container to unload cargo from the liners inside the cargo container.

FIG. 22 shows cargo container 50 holding two liners 204 and 206, one on top of the other, and including two bracing systems 210 and 212, with each bracing system engaging and helping to support a respective one of the liners. More specifically, liner 204 is positioned on and supported by the floor of the container body, and liner 206 is positioned on an supported by liner 206. Bracing system 210 includes a plurality of straps 210*a* and 201*b* connected to the container body and extending across a back panel of liner 204 to hold the liner inside the container body, and bracing system 212 includes a plurality of straps 212*a* and *b* connected to the container body and extending across a back panel of liner 206 to hold that liner inside the container body.

For example, with the cargo container shown in FIG. 22, liquids may be carried in the bottom liner, and the top liner may carry light weight products such as styrofoam or peanuts in shells. The top liner prevents the bottom liner from surging, by occupying the space inside the cargo container above the bottom liner. Typically, liquid cargo would be discharged from the upper liner before cargo is discharged from the bottom liner.

FIG. 23 shows cargo container 50 holding two liners 214 and 216, one in front of the other, and also including two bracing systems 220 and 222, each of which engages and supports a respective one of the liners. Both of the liners 214 and 216 are positioned on and supported by the floor of the cargo container, and liner 214 is located forward of liner 216. Bracing system 220 includes a plurality of straps connected to the container body and extending, preferably both vertically and horizontally, across a back panel of liner 214 to hold the liner inside the container body; and bracing system 222 includes a plurality of straps connected to the container body and extending, also preferably both vertically and horizontally, across a back panel of liner 216 to hold the liner inside the container body.

Each of the liners 214 and 216 includes a respective discharge outlet 224 and 226 to discharge cargo from the liner; and the cargo container 50 further includes a discharge conduit 230 to allow cargo to be discharged from liner 214 while liner 216 is still inside the cargo container body, either before or after the latter liner is itself emptied of cargo. Conduit 230 is in communication with discharge outlet 224 of liner 214 and extends forward therefrom, through liner 216, to discharge cargo from the first liner and through the second liner. Conduit 230 may be made, for example, of a metal or solid plastic. Conduit 230 may also be flexible such as a plastic roll-out sleeve that can be rolled out to the rear of the container after the rear compartment liner is emptied.

FIG. 24 shows cargo container 50 holding three liners 232, 234 and 236 arranged in series in the container, from the front to the back thereof, and three bracing systems 240, 242 and 244, each of which engages and supports a respective one of the liners inside the cargo container. Each of the liners 232, 234 and 236 are positioned on and supported by the floor of the cargo container; and liner 232 is located in a forward portion of the cargo container, liner 234 is located immediately rearward of liner 232, and liner 236 is located immediately rearward of liner 234. Bracing system 240 includes a plurality of straps connected to the container body and extending across a back panel of liner 232 to hold the liner inside the container body, bracing system 242 includes a plurality of straps connected to the container body and extending across a back panel of liner 234 to hold the liner inside the container body, and bracing system 244 includes a plurality of straps connected to the container body and extending across a back panel of liner 236 to hold that liner inside the container body. Each of the liners 232, 234 and 236 may be provided with closed end caps with threaded fittings, or flexible loading and unloading chutes that can reach the rear of the container so that cargo can be conducted into the liner and subsequently discharged therefrom.

Figure 25:
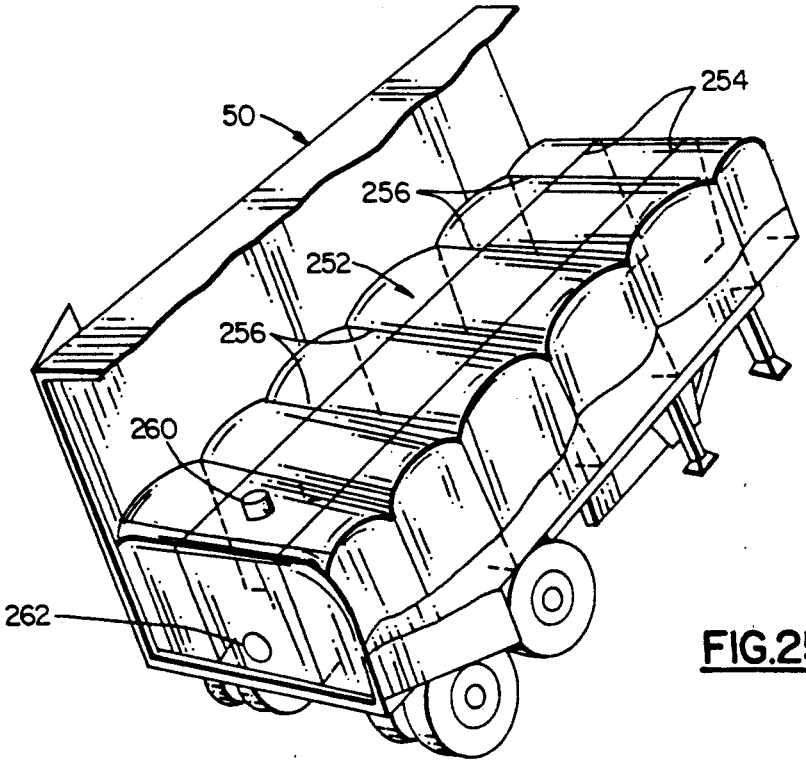

FIG. 25 shows container 50 having liner 250 and bracing system 252. This bracing system is especially well suited for supporting a liner that holds a liquid or semi-liquid because the bracing system inhibits or prevents liquids from surging inside the liner. More specifically, bracing system 252 includes a plurality of longitudinally extending straps 254 and a multitude of transversely extending straps 256. Each of the longitudinal straps is connected to the container floor, beneath a rearward portion of liner 250, and the strap extends upwards against a back panel of the liner and forwards, against the top of the liner, to a front thereof. Each of the longitudinal straps then extends downward, forward of a front panel of the liner and is secured to the container floor, underneath a forward portion of the liner.

Each of the transversely extending straps 256 is connected to the container floor, beneath a right portion of the liner 250, extends upwards along the right side of the liner, and then extends over and against the top of the liner to the left side thereof. Each of the transversely extending straps 256 then extends downward, along the left side of the liner and is connected to the container floor, beneath a left portion of the liner. A filler spout 260 is connected to the liner 250 to conduct cargo into the liner, and an unloading spout 262 is connected to the liner to discharge cargo therefrom.

With each of the cargo containers shown in FIGS. 22–25, one or more bulkheads may be used, if desired, to further support one or more of the liners inside the cargo container, or to facilitate loading cargo into or unloading from the liners inside the cargo container. To simplify the illustrations, these bulkheads are not shown in FIGS. 22–25.

With reference to FIGS. 1 and 11, one liner 10 is fully secured inside container 50, cargo may be loaded into the lined container, also via inlet 30*c*. To unload the cargo from container 50, outlet 30*d* is opened and the front end of the container is raised so that the cargo slides rearward and out through opening 30*d* in back panel 30.

FIGS. 26 and 27 generally illustrate an alternate method for discharging cargo from container 50. In accordance with this method, a gas is conducted into liner 10 through inlet port 30*c* to increase the pressure on or above the bulk cargo 90 therein, and gas and substantially the complete supply of bulk cargo inside the liner is drawn out therefrom through liner outlet 30*d*, without tilting container 50 or liner 10. It has been found that by creating a suitable disturbance of the bulk cargo inside the liner, that cargo can be fluidized and drawn out through discharge outlet 30*d* without tilting the cargo container or the liner; and moreover, by firmly securing the liner inside the cargo container, as taught hereinabove, the liner is able to withstand the turbulence needed to create the desired fluidized cargo.

More specifically, gas supply line 90 is connected to a pressurized gas source, schematically represented at 92 in FIG. 26, which may supply pressurized air or nitrogen for example, and this line 90 is also connected to liner inlet 30*c* via an inlet chute; and discharge line 96 is connected to a low pressure or vacuum source which may be a conventional pump, and this line 96 is also connected to liner outlet 30*d* via an outlet chute. Pressurized air is conducted into liner 10 through hose 92, while gas and product is withdrawn from the liner through hose 96. Preferably, during at least most of the time during which product is withdrawn from the liner, the volume of gas conducted into the liner is at about, or substantially at, the same rate at which the volume of the gas and cargo withdrawn from the liner; and to help accomplish this, it is desirable to use a supply hose 92 having a diameter that is the same as the diameter of discharge hose 96.

In addition, preferably, during at least most of the time during which cargo is discharged from liner 10, the pressure on the cargo is maintained slightly above the ambiant atmospheric pressure. The air pressure inside the liner is preferably high enough to keep the liner inflated inside container 50, but this pressure should not be allowed to increase to a level where it might damage the cargo container. Pressure sensors, not shown, may be located inside container 50 or liner 10 and connected to pressurized gas source 94 to sense the pressure inside the liner and to deactivate the pressurized gas source to stop the flow of gas into the liner when the pressure therein rises above a given level. Further, under some circumstances, especially if the liner 10 is completely filled with cargo, it may be desirable to start unloading by withdrawing same cargo by vacuum from the liner to develop a space above the cargo therein, before conducting gas or air into the liner via hose 92.

Upper and lower connecting segments 32 and 34 provide a multitude of localized high strength, reinforced areas on liner 10 to connect the liner to inside surfaces of a cargo container, and consequently the liner can be tightly secured within the container. As a result, for example, the bottom of the liner can be stretched comparatively tightly across the cargo container without any, or with a minimal number of, wrinkles in the bottom panel of the liner, thus eliminating the stresses and other problems associated with such wrinkles. Moreover, even if a tear or rip develops in a connecting segment, as a result of a rope, staple or other fastener being pulled away from that connecting segment, that connecting segment will still seal the interior of the liner from that tear or rip. This, first, prevents cargo from leaking out from the interior of the liner through the tear or rip, and second, prevents the cargo from being exposed to outside contaminants through the tear or rip.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

We claim:

1. A liner for a cargo container defining an interior cargo space, a liner comprising a flexible and expandable body adapted to fit inside the cargo space and defining an interior to hold a bulk cargo, the expandable body including at least first and second adjacent panels forming an edge, a multitude of reinforcing members and a multitude of connecting segments located adjacent said edge;

each connecting segment comprising a multitude of layers located one on top of another over a respective one given area, said given area defining a perimeter of the connecting segment;

the layers of the connecting segment forming at least one through opening spaced from said perimeter and extending through said layers to help secure the liner to the cargo container; and the multitude of layers of each connecting segment including i) a first layer comprising a first section of a respective one of the reinforcing members, ii) a second layer comprising a respective one portion of the first panel, iii) a third layer comprising a respective one portion of the second panel, and iv) a fourth layer comprising a second section of the respective one of the reinforcing member; and the multitude of layers of each connecting segment being bonded together completely over the respective given area of the connecting segment to maintain the interior of the liner and a bulk cargo therein sealed from tears that develop in the connecting segment and extending outward from the through opening in the connecting segment to said edge of the liner.

2. A liner according to claim 1, wherein the layers of each connecting segment form a multitude of through openings extending through said layers and spaced from the perimeter of the connecting segment.

3. A liner according to claim 2, wherein each of the through openings of each connecting segment is spaced at least one-half inch from the perimeter of the connecting segment.

4. A liner according to claim 3, wherein, over substantially the entire given area of each connecting segment, the second layer of the connecting segment is heat sealed to both the first and third layers thereof, and the third layer of the connecting segment is heat sealed to both the second and fourth layers thereof.

5. A method of forming a connecting segment on a flexible liner for a cargo container, the flexible liner defining an interior to hold a bulk cargo and including at least first and second adjacent panels forming an edge, the method comprising:

holding said first and second panels against each other over an area, said area extending from said edge and having a perimeter;

holding a first section of a reinforcing member against the first panel over said area;

holding a second section of the reinforcing member against the first panel over said area;

forming at least one opening through said multitude of layers to help secure the liner to the cargo container, said opening being spaced from the perimeter of said area; and bonding the reinforcing member to both the first and second panels and bonding the first and second panels to each other completely over said area, to form a sealed region comprised of a multitude of layers laminated to each other, and to maintain the interior of the liner and a bulk cargo therein sealed from tears that develop in the connecting segment and extending outward from the through opening in the connecting segment to said edge of the liner.

6. A method according to claim 5, wherein the bonding step includes the step of bonding the reinforcing member to both of said first and second panels, and simultaneously bonding said first and second panels to each other over said area to form said sealed region.

7. A method according to claim 6, wherein the forming step includes the step of forming said through opening at least one-half inch from said perimeter.

8. A method according to claim 6, wherein the forming step includes the step of forming a plurality of openings through said multitude of layers, each of the through openings being spaced at least one-half inch from said perimeter.

9. A method according to claim 6, wherein the reinforcing member includes a central portion located directly over the area, and an excess portion extending outside said area, and the method further includes cutting said excess portion from said central portion.

10. A method according to claim 5, wherein the bonding step includes the step of heat sealing the reinforcing member to the first and second panels of the liner, and simultaneously heat sealing the first and second panels to each other over said area.

11. A liner for a cargo container defining an interior cargo space, the liner comprising a flexible and expandable body adapted to fit inside the cargo space and defining an interior to hold a bulk cargo, the expandable body including at least first and second adjacent panels forming an edge, a multitude of first reinforcing members, a multitude of second reinforcing members, and a multitude of connecting segments located along said edge to help connect the liner to the cargo container;

each connecting segment comprising a multitude of layers located one on top of another and held together within a given area, said given area defining a perimeter of the connecting segment;

the multitude of layers of each connecting segment including i) a first layer comprising a respective one portion of the first panel, ii) a second layer comprising a respective one portion of the second panel, iii) a third layer comprising a first section of a respective one of the first reinforcing members, iv) a fourth layer comprising a second section of the respective one of the first reinforcing members, and v) a fifth layer comprising a respective one of the second reinforcing members, wherein said fifth layer is captured between a pair of other layers of the connecting segment, said fifth layer is spaced from the perimeter of the connecting segment, and said pair of other layers are bonded together completely over the portion of the given area outside said fifth layer to maintain the interior of the liner and a bulk cargo therein sealed from tears that develop in the connecting segment and extending outward through said fifth layer to said edge of the liner.

12. A liner according to claim 11, wherein said pair of other layers of the connecting segment comprises the second and third layers thereof.

13. A liner according to claim 12, wherein the first, second and fourth layers of each connecting segment are bonded together completely over the given area of the connecting segment.

14. A cargo container, comprising:

a container body defining an interior cargo space, and including a floor, a roof, and left and right side walls;

a flexible and expandable liner secured inside the container body and defining an interior for holding a bulk cargo, the liner including a bottom panel, a top panel and left and right side panels, the bottom and left side panels being connected together and forming a left bottom edge, the bottom and right side panels being connected together and forming a right bottom edge, the top and left side panels being connected together and forming a left top edge, and the top and right side panels being connected together and forming a right top edge;

a multitude of lower right connecting segments spaced apart along the bottom right edge of the liner, each of the lower right connecting segments comprising a multitude of layers located one on top of another within a given area, said given area defining a perimeter of the connecting segment, the layers of each lower right connecting segment including i) a respective one first portion of the bottom panel, ii) a respective one first portion of the right panel, iii) a respective one first reinforcing member, and iv) first and second sections of a respective one second reinforcing member;

a multitude of lower left connecting segments spaced apart along the bottom left edge of the liner, each of the lower left connecting segments comprising a multitude of layers located one on top of another within a given area, said given area defining a perimeter of the connecting segment, the layers of each lower left connecting segment including i) a respective one second portion of the bottom panel, ii) a respective one first portion of the left panel, iii) a respective one third reinforcing member, and iv) first and second section of a respective one fourth reinforcing member;

a multitude of upper right connecting segments spaced apart along the top right edge of the liner, each of the upper right connecting segments comprising a multitude of layers located one on top of another, the layers of each upper right connecting segment forming a through opening extending through the connecting segment, and including i) a respective one first portion of the top panel, ii) a respective one second portion of the right panel, iii) first and second sections of a respective one fifth reinforcing member;

a multitude of upper left connecting segments spaced apart along the top left edge of the liner, each of the upper left connecting segments comprising a multitude of layers located one on top of another, the layers of each upper left connecting segment forming a through opening extending through the connecting segment, and including i) a respective one second portion of the top panel, ii) a respective one second portion of the left panel, iii) first and second sections of a respective one sixth reinforcing member;

a multitude of first fasteners, each of the first fasteners extending through the first reinforcing member of a respective one of the lower right connecting segments and into the floor of the container body to secure said one lower right connecting segment to said floor;

a multitude of second fasteners, each of the second fasteners extending through the third reinforcing member of a respective one of the lower left connecting segments and into the floor of the container body to secure said one lower left connecting segment to said floor;

a multitude of third fasteners, each of the third fasteners extending through the opening of a respective one of the upper right connecting segments and being connected to the container body to connect said one upper right connecting segment thereto; and a multitude of fourth fasteners, each of the fourth fasteners extending through the opening of a respective one of the upper left connecting segments and being connected to the container body to connect said one upper left connecting segment thereto;

wherein the first reinforcing member of each of the lower right connecting segments is captured between a pair of other layers of said each lower right connecting segment, said first reinforcing member is spaced from the perimeter of said lower right connecting segment, and said pair of other layers are bonded together completely over the portion of the given area of the connecting segment outside said first reinforcing member to maintain the interior of the liner and a bulk cargo therein sealed from tears that develop in the connecting segment and extending outward through said first reinforcing member to the bottom right edge of the liner; and wherein the third reinforcing member of each of the lower left connecting segments is captured between a pair of other layers of said each lower left connecting segment, said third reinforcing member is spaced from the perimeter of said lower left connecting segment, and said pair of other layers are bonded together completely over the portion of the given area of the connecting segment outside said third reinforcing member to maintain the interior of the liner and bulk cargo therein sealed from tears that develop in the connecting segment and extending outward through said third reinforcing member to the bottom left edge of the liner.

15. A cargo container according to claim 14, wherein:

the layers of each upper right and upper left connecting segments are bonded together completely over a respective one area, said one area defining a perimeter of the upper connecting segment; and the through opening of each of the upper right and upper left connecting segments is spaced from the perimeter of the connecting segment.

16. A cargo container according to claim 15, wherein:

in each lower right connecting segment, the first reinforcing member of the connecting segment is held between the respective one portion of the right panel and the first section of the respective one second reinforcing member of the connecting segment; and in each lower left connecting segment, the third reinforcing member of the connecting segment is held between the respective one portion of the left panel and the first section of the respective one fourth reinforcing member of the connecting segment.

* * * * *